US006547330B1

(12) United States Patent
Hester

(10) Patent No.: US 6,547,330 B1
(45) Date of Patent: Apr. 15, 2003

(54) BODY SUPPORT SYSTEM

(75) Inventor: Robert George Hester, Wellington (GB)

(73) Assignee: Easy Care Products Limited (GB)

( * ) Notice: Subject to any disclaimer, the term of this patent is extended or adjusted under 35 U.S.C. 154(b) by 0 days.

(21) Appl. No.: 09/718,844

(22) Filed: Nov. 22, 2000

(30) Foreign Application Priority Data

Nov. 27, 1999 (GB) ..... 9928001

(51) Int. Cl.[7] ..... A47C 1/02
(52) U.S. Cl. ..... 297/322; 297/340
(58) Field of Search ..... 297/344.18, 340, 297/316, 322, 84, 354.13, 300.1, 440.14, 440.22

(56) References Cited

U.S. PATENT DOCUMENTS 2,470,364 A * 5/1949 Niederhauser
2,909,212 A * 10/1959 Scherer
3,191,990 A 6/1965 Rugg et al.
3,215,469 A * 11/1965 Wamsley
4,572,573 A * 2/1986 Yoshikawa et al.
5,050,899 A 9/1991 Stensby
5,335,969 A * 8/1994 Yamaguchi et al.
5,779,317 A * 7/1998 Neal

FOREIGN PATENT DOCUMENTS

EP 0155918 9/1985

OTHER PUBLICATIONS

European Search Report Jun. 13, 2002.

* cited by examiner

*Primary Examiner*—Milton Nelson, Jr.
(74) *Attorney, Agent, or Firm*—Ira S. Dorman

(57) ABSTRACT

A body support system comprises a seat (3) including a base (19) and a seat member (21). The seat member (21) is slidably mounted on the base (19). A back support (7) is pivotable relative to the seat, and a connecting member (25) extends between the back support and the seat member (21) so as to urge the seat member to slide relative to the base (19) towards the back support as the back support is pivoted towards an in-line arrangement with the seat.

17 Claims, 5 Drawing Sheets

BODY SUPPORT SYSTEM

This invention relates to a body support system for example for patients or the like. The support system may be used to move patients, such as sick, elderly or disabled persons, between various supported positions with minimal discomfort.

BACKGROUND TO THE INVENTION

Moving a sick, elderly or disabled person between various positions, such as lying, sitting and standing, can be very demanding, requiring the co-operation of two or three carers and can be distressing and uncomfortable for the patient. When such movement is effected by means of a specially adapted chair or the like, the distress cause by the movement is reduced and the risk of injury to the carers is effectively eliminated, as is the need for multiple carers to move the patient.

It is necessary to move an immobile patient between a lying position and a sitting position and between a sitting position and a standing position for a number of reasons. For example, for patients who are immobile it is necessary to replace the normal wheelchair seat with a commode seat in order for the patient to be able to use toilet facilities. It is also necessary to be able to rearrange the clothing of a patient for the above and other reasons.

DESCRIPTION OF PRIOR ART

In order to accomplish these tasks it is necessary to be able to raise a patient from a seat, ideally substantially to a standing position.

However, such specially adapted chairs are not altogether satisfactory because the relatively movable parts of the chair tend to move in a manner that causes movement along the length of the patient, that is there is shear movement between the parts of the chair and the patient, not simply pivoting movement. The shear movement can damage a patient's skin and lead to sores and other ailments developing which, in turn, can be difficult to cure.

OBJECT OF THE INVENTION

It is therefore an object of the present invention to provide a body support system which is capable of moving a patient or the like between various supported positions in a manner in which the patient suffers no shear movement.

SUMMARY OF THE INVENTION

According to the present invention there is provided a body support system comprising a seat including a base and a seat member slidably mounted thereon, a back support pivotable relative to the seat, and a connecting member extending between the back support and the seat member so as to urge the seat member to slide relative to the base towards the back support as the back support is pivoted towards an in-line arrangement with the seat.

The body support system may include a lower limb support pivotable relative to the seat and a connecting member extending between the lower limb support and the seat member so as to urge the seat member to slide relative to the base towards the lower limb support as the lower limb support and the back support are pivoted away from an in-line arrangement with the seat. A stabiliser may be provided in the region of a free end of the lower limb support.

Alternatively, biasing means may be provided for the seat member so as to tend to move the seat member away from the back support.

Means may be provided for raising and lowering the seat, for example a telescopic mounting.

The seat may be pivotably mounted on support means for pivoting about a generally horizontal axis. Stop means may be provided for limiting pivoting movement of the seat relative to the support means.

At least one of the connecting members may comprise an elongate inextensible flexible member, such as a strap.

The seat member may be pivotably mounted relative to the base for rotation about a generally horizontal axis.

The seat member may be provided with a removable portion.

The seat may be provided with a cam member which is rotatable in response to pivoting movement of the back support relative to the seat, the cam member operating against a support for the seat so as to control inclination of the seat relative to the seat support as the back support is pivoted.

For a better understanding of the present invention and to show more clearly how it may be carried into effect reference will now be made, by way of example, to the accompanying drawings in which:

DESCRIPTION OF PREFERRED EMBODIMENTS

Figure 1:
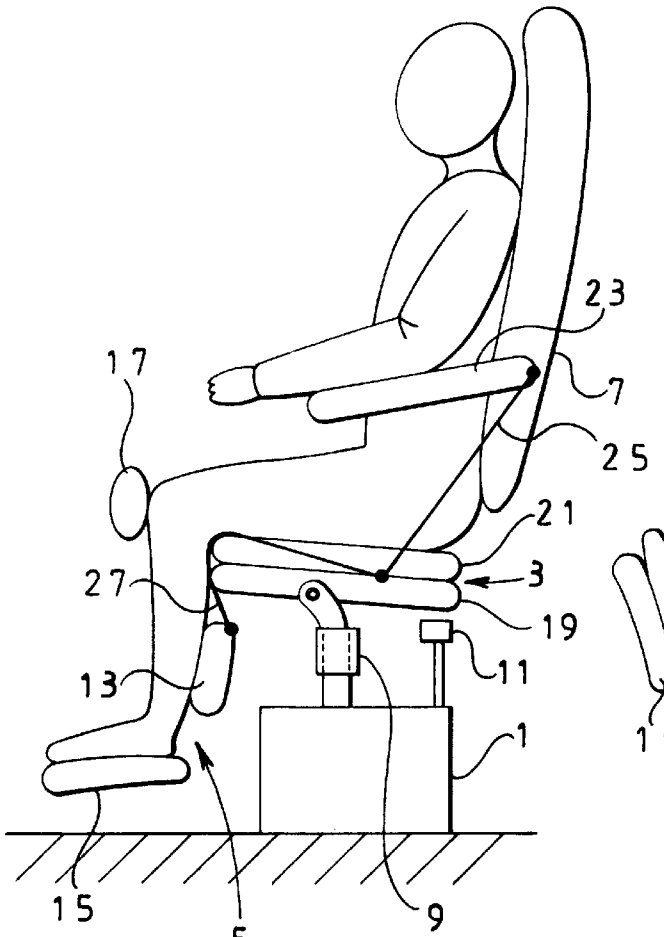
FIG. 1 is a diagrammatic side elevational view of one embodiment of a body support system according to the present invention, the body support system being shown in a sitting arrangement.

The body support system shown in FIG. 1 is diagrammatic and incomplete. The features not shown in FIG. 1 are described hereinafter and/or shown in the other figures. The body support system can be, for example, a wheelchair, a static or mobile lounge chair, a static or mobile bed, or a dental/therapy/examination platform.

The body support system comprises a support structure 1 to which is mounted an elevatable seat 3 having pivotably mounted relative thereto about a generally horizontal axis (such as by way of a parallelogram arrangement) a lower limb support 5 and a back support 7.

The seat 3 is elevatable by means of a telescopic mounting 9 and can be lowered to bear against a stop 11.

The lower limb support 5 comprises a calf support 13 and a footrest 15. In addition a removable knee brace 17 may be provided. The lower limb support 5 is effectively pivotable between the position shown in FIG. 1 and a generally horizontal configuration as shown in FIG. 2.

The seat 3 comprises a seat base 19 (which may simply be a frame) and a seat pad 21 which is slidably mounted on the seat base as will be described in more detail hereinafter. The stop 11 is positioned towards the rear of the seat base 19 in order to limit downward movement of the rear of the base. The seat base 19 is pivotably mounted on the upper end of the telescopic mounting 9 about a generally horizontal axis.

Figure 2:
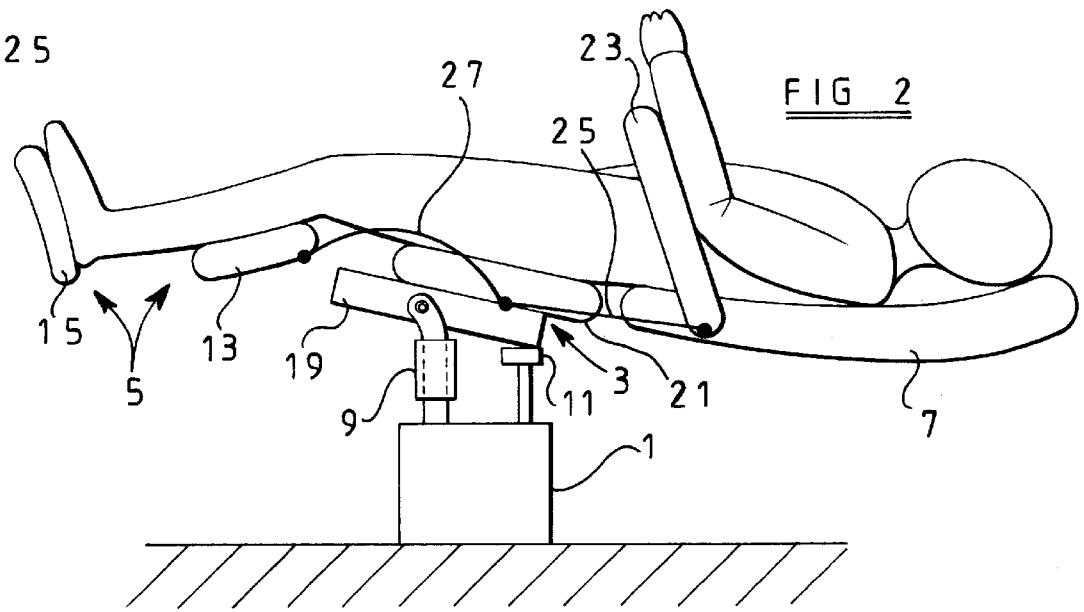
FIG. 2 shows the body support system of FIG. 1 in a lying position.

The back support 7 is effectively pivotable between the position shown in FIG. 1 and a generally horizontal configuration as shown in FIG. 2. The back support is provided with armrests 23 for supporting the arms of a patient.

Figure 3:
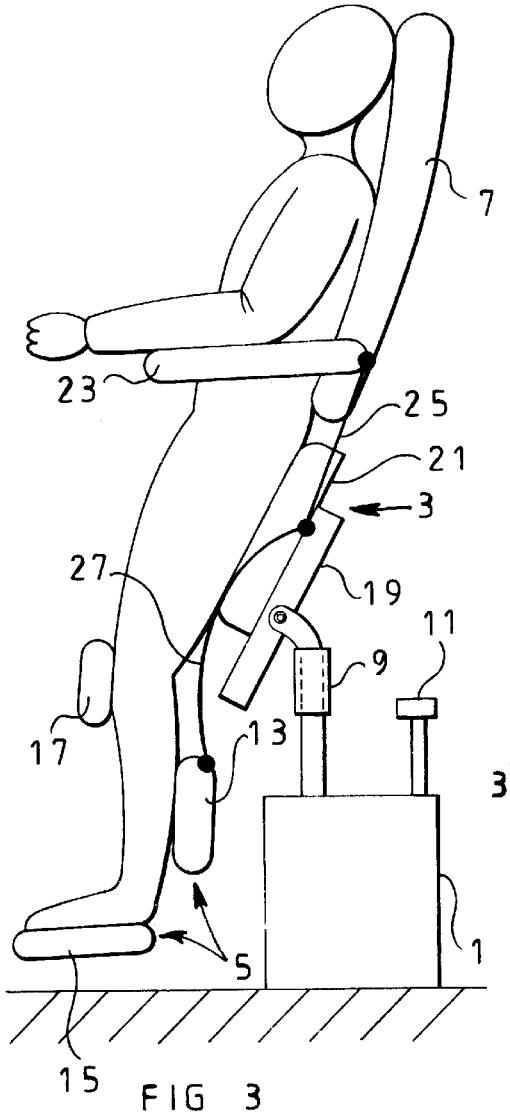
FIG. 3 shows the body support system of FIG. 1 in a semi-standing position.

The seat pad 21 is connected to the back support 7 by way of one or more straps 25 or the like and to the lower limb support 5 by way of one or more straps 27 or the like. The straps 25 and 27 or the like provide an elongate inextensible flexible connection between the seat pad and each of the back support and the lower limb support. The straps 25 and 27 are connected to the back support 7 and lower limb support 5 at a point thereon which is movable towards and away from the seat, for example at a point other than an axis about which the back support and the lower limb support is pivotable. Thus, when the seat 3 is generally perpendicular to the lower limb support 5 and to the back support 7 (as shown in FIG. 1) the straps 27 are relatively taut so as to urge the seat pad 21 forwardly on the base 19 (i.e., towards the lower limb support 5), while the straps 25 are relatively slack. However, when the seat 3 is generally in-line with the lower limb support 5 and with the back support 7 (as shown in FIGS. 2 and 3) the straps 25 are relatively taut so as to urge the seat pad 21 rearwardly on the base 19 (i.e., towards the back support 7), while the straps 27 are relatively slack. In this way the seat pad 21 is able to adjust its spacing from the lower limb support 5 and, more especially, from the back support 7, as the relative angles between the seat pad and the lower limb support and back support change. This allows the seat pad 21 to move with the patient's skin (or clothing) as the knee and hip joints flex. More specifically, as the knee joint straightens, because the lower limb support 5 and the seat pad 21 are on the inside of the joint, the distance between the two components needs to increase to prevent shear movement (and conversely to decrease as the joint bends), while as the hip joint straightens, because the seat pad 21 and back support 7 are on the outside of the joint, the distance between the two components needs to decrease to prevent shear movement (and conversely to increase as the joint bends).

Figure 4:
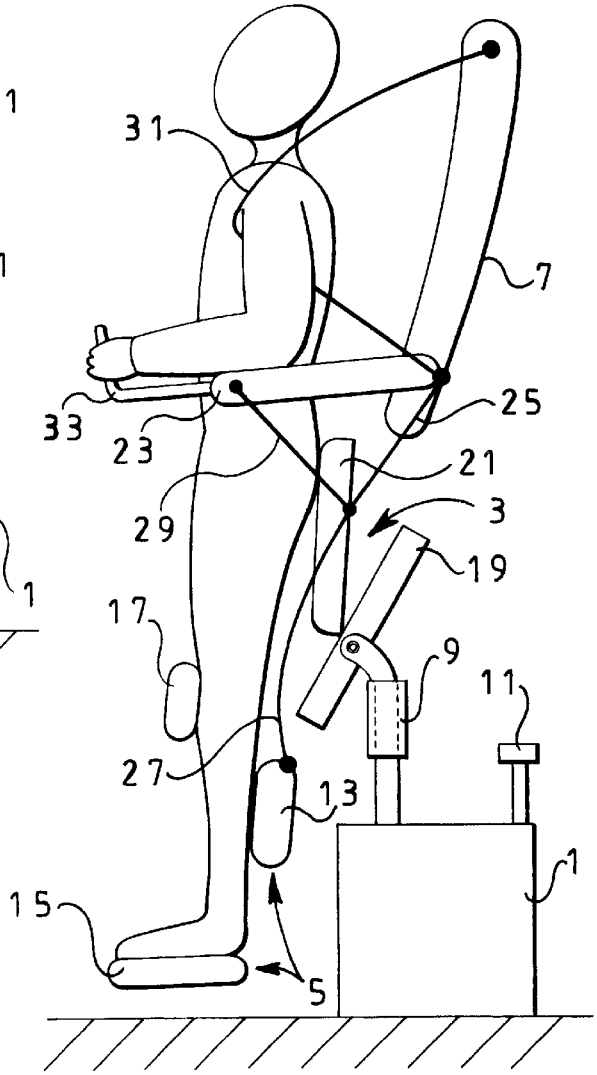
FIG. 4 shows the body support system of FIG. 1 in a fully standing position.
Figure 5:
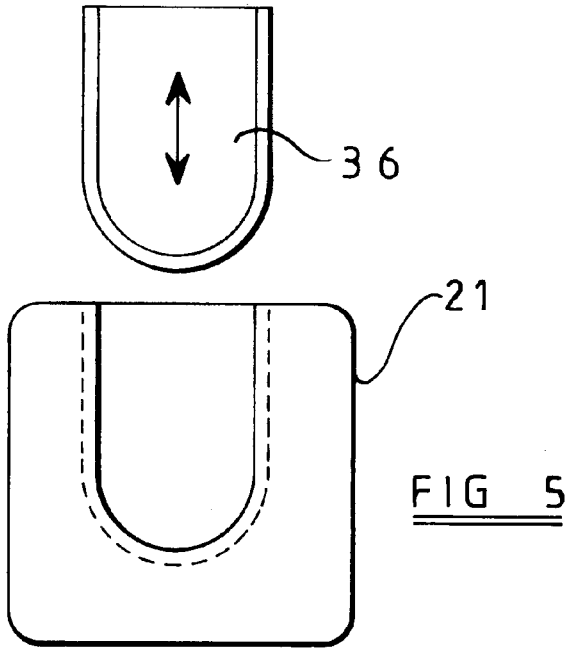
FIG. 5 shows how the seat pad can be adapted to provide a toilet aperture.
Figure 6:
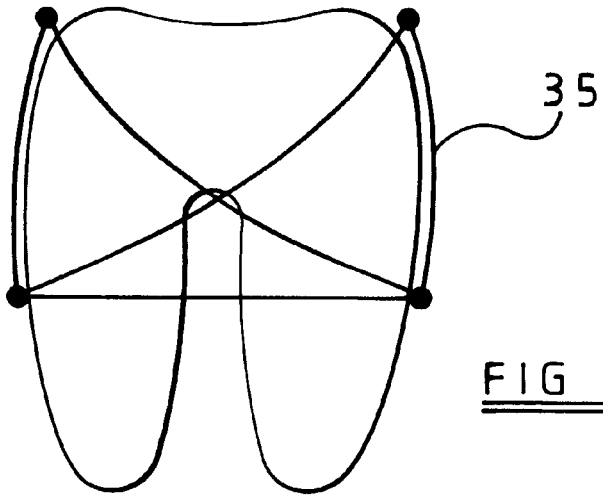
FIG. 6 is a diagrammatic illustration of a sling arrangement.
Figure 8:
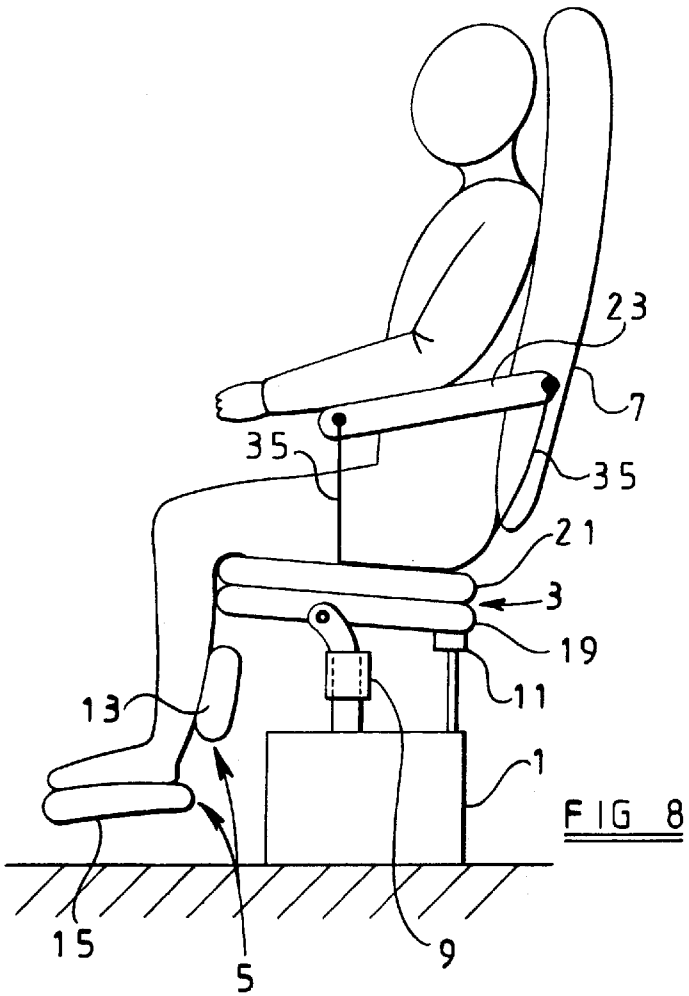
FIG. 8 shows another manner in which the sling arrangement of FIG. 6 can be employed.
Figure 7:
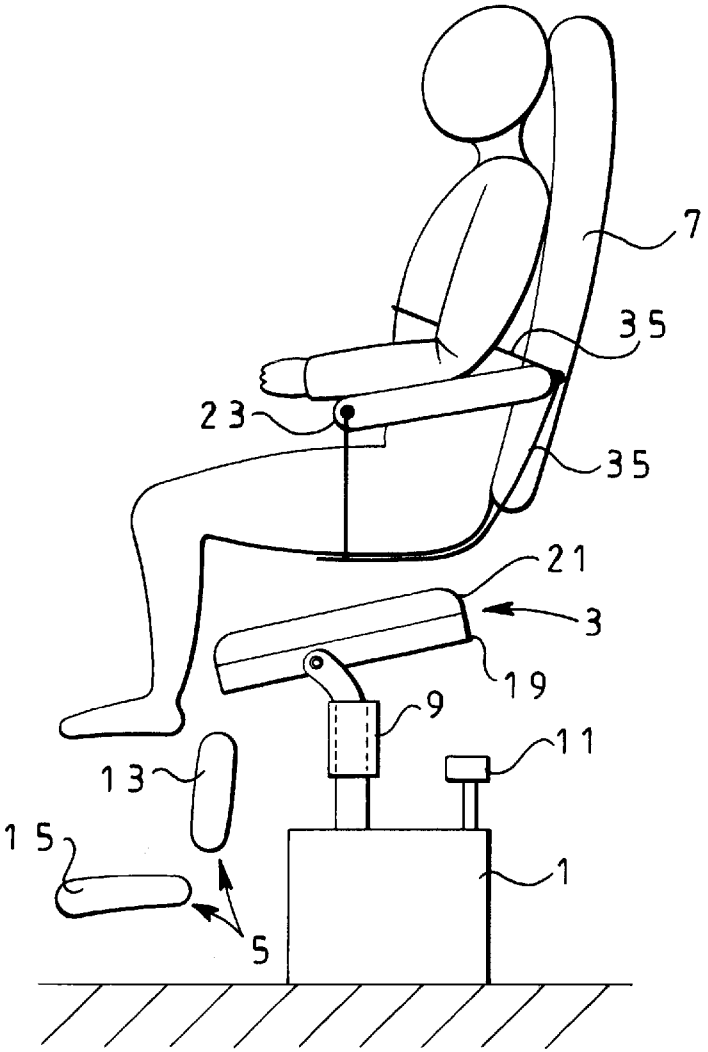
FIG. 7 shows one manner in which the sling arrangement of FIG. 6 can be employed.

FIG. 4 shows how, when the seat pad 21 is pivotably mounted on the seat base 19 about a generally horizontal axis, in addition to being slidable, further straps 29 can be provided between the seat pad 21 and the armrests 23 of the back support 7 to urge the patient forwards to a standing position. A chest harness 31 prevents the patient toppling forwards and hand grips 33 or the like can also be provided for additional arm support. In this configuration the weight on the seat pad 21 is considerably reduced, or removed, and it is possible to extract a portion 36 of the seat pad 21 to provide a toilet aperture in the manner illustrated in FIG. 5. Alternatively, the patient can be supported in a sling 35 as shown in FIGS. 6 and 7 or 6 and 8, either above the seat pad 21 as shown in FIG. 7 or on the seat pad as shown in FIG. 8.

Figure 10:
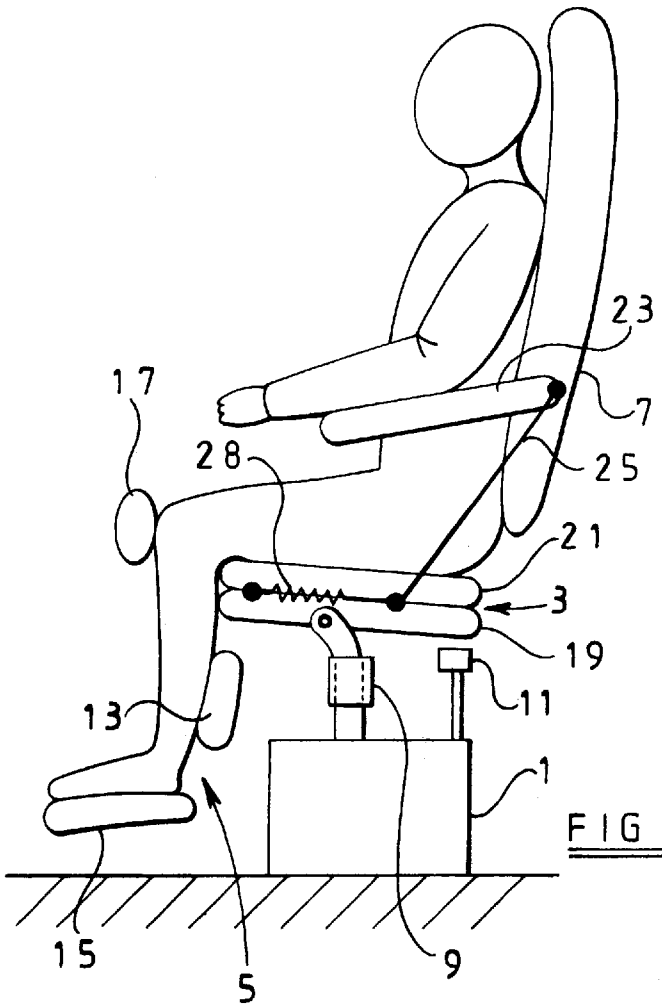
FIG. 10 is a diagrammatic side elevational view of an alternative embodiment of a body support system according to the present invention, the body support system being shown in a sitting arrangement.

It may not be necessary in all cases to provide the straps 27 in order to return the seat pad to its forward position on the base 19. As an alternative, as shown diagrammatically in FIG. 10, the seat pad 21 can be biased towards a forward position by a suitable resilient means 28 such that the pad automatically returns to the forward position as the seat 3 and back support 7 are moved towards a generally perpendicular configuration.

Figure 9:
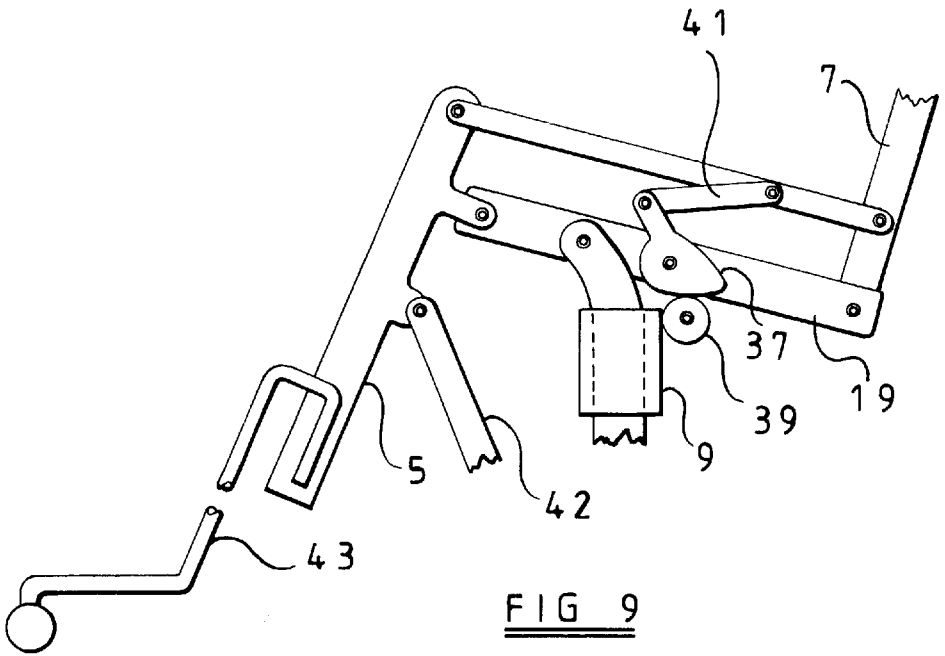
FIG. 9 shows a mechanism by which elevation and inclination of the body support system can be controlled.

FIG. 9 shows a mechanism by which the elevation and inclination of the body support system can be controlled, that is a mechanism which does not rely on the stop 11.

FIG. 9 shows in more detail the parallelogram arrangement by which relative inclination of each of the lower limb support 5 and back support 7 to the seat 3 are coordinated through the seat itself.

As shown, a cam member 37 is pivotably mounted on a lower member of the parallelogram arrangement, with the cam bearing against a roller 39 or the like mounted in the upper region of the telescopic mounting 9. The cam member 37 is rotated by a lever 41 extending from the cam member to an upper member of the parallelogram. As the back support 7 and/or the lower limb support 5 is moved towards an in-line arrangement with the seat 3, the lever 41 rotates the cam member 37 so as to urge the rear of the seat 3 upwardly towards a substantially horizontal configuration. Conversely, as the back support 7 and/or the lower limb support 5 is moved towards a generally perpendicular arrangement with the seat 3, the lever 41 rotates the cam member 37 so as to allow the rear of the seat 3 to move downwardly to an inclined configuration. A strut 42 extends between the lower limb support 5 and the support structure (not shown in FIG. 9), the strut 42 being adjustable in length to determine, in combination with the telescopic mounting 9 and the parallelogram arrangement, the configuration of the lower limb support 5, back support 7 and seat. The strut 42 may be preset in a number of different lengths or may be continuously adjustable.

As shown in FIG. 9, a stabiliser 43 may be provided towards the free end of the lower limb support 5, which stabiliser may be removable. The stabiliser 43 moves with the lower limb support 5 such that the free end of the stabiliser is close to the ground when the body support system is used for sitting or standing, but is raised from the ground for greater clearance when the seat 3 is tilted back on the stop 11.

I claim:

1. A body support system comprising a seat including a base and a seat member slidably mounted thereon, a back support pivotable relative to the seat, and a connecting member extending between the back support and the seat member so as to urge the seat member to slide relative to the base towards the back support as the back support is pivoted towards an in-line arrangement with the seat, wherein the connecting member comprises an elongate inextensible flexible strap.

2. A body support system according to claim 1 and including a lower limb support pivotable relative to the seat and a connecting member extending between the lower limb support and the seat member so as to urge the seat member to slide relative to the base towards the lower limb support as the lower limb support and the back support are pivoted away from an in-line arrangement with the seat.

3. A body support system according to claim 2, wherein a stabiliser is provided in a region of a free end of the lower limb support.

4. A body support system according to claim 1, wherein the seat is provided with a cam member which is rotatable in response to pivoting movement of the back support relative to the seat, the cam member operating against a support for the seat so as to control inclination of the seat relative to the seat support as the back support is pivoted.

5. A body support system according to claim 1, wherein means is provided for raising and lowering the seat.

6. A body support system according to claim 5, wherein the seat raising and lowering means comprises a telescopic mounting.

7. A body support system according to claim 1, wherein the seat is pivotably mounted on support means for pivoting about a generally horizontal axis.

8. A body support system according to claim 7, wherein stop means is provided for limiting pivoting movement of the seat relative to the support means.

9. A body support system according to claim 1, wherein the seat member is pivotably mounted relative to the base for rotation about a generally horizontal axis.

10. A body support system according to claim 1, wherein the seat member is provided with a removable portion.

11. A body support system comprising a seat including a base and a seat member slidably mounted thereon, a back support pivotable relative to the seat, a connecting member extending between the back support and the seat member so as to urge the member to slide relative to the base towards the back support as the back support is pivoted towards an in-line arrangement with the seat, and a cam member rotatable in response to pivoting movement of the back support relative to the seat, the cam member operating against a support for the seat so as to control inclination of the seat relative to the seat support as the back support is pivoted.

12. A body support system according to claim 11, wherein means is provided for raising and lowering the seat.

13. A body support system according to claim 12, wherein the seat raising and lowering means comprises a telescopic mounting.

14. A body support system according to claim 11, wherein the seat member is pivotably mounted relative to the base for rotation about a generally horizontal axis.

15. A body support system according to claim 11 and including a lower limb support pivotable relative to the seat and a connecting member extending between the lower limb support and the seat member so as to urge the seat member to slide relative to the base towards the lower limb support as the lower limb support and the back support are pivoted away from an in-line arrangement with the seat.

16. A body support system according to claim 15, wherein a stabiliser is provided in a region of a free end of the lower limb support.

17. A body support system according to claim 11, wherein the seat member is provided with a removable portion.

* * * * *